United States Patent [19]

Hiller et al.

[11] 3,941,168

[45] Mar. 2, 1976

[54] LIQUID DISPENSING AND VAPOR RECOVERY SYSTEM UTILIZING AN INJECTOR AND A VAPOR FLOW CONTROL VALVE

[75] Inventors: Trueman W. Hiller; Klaus D. Jarr, both of Bettendorf, Iowa

[73] Assignee: Weil-McLain Company, Inc., Dallas, Tex.

[22] Filed: Dec. 19, 1974

[21] Appl. No.: 534,448

[52] U.S. Cl. ..... 141/46; 141/59; 222/318

[51] Int. Cl.[2] ..... B67D 5/04

[58] Field of Search ..... 141/45, 46, 290, 59, 302; 220/85 VR, 85 VS; 222/109, 110, 318

[56] References Cited

UNITED STATES PATENTS

| | | | |
|---|---|---|---|
| 2,090,734 | 8/1937 | Piquereg | 222/318 X |
| 2,356,428 | 8/1944 | Ranney | 123/198 |
| 2,401,124 | 5/1946 | Walker et al. | 141/290 X |
| 2,650,003 | 8/1953 | Collman | 222/318 |
| 2,919,834 | 1/1960 | Rugeley et al. | 222/52 |
| 3,763,901 | 10/1973 | Viland | 141/8 |
| 3,826,291 | 7/1974 | Steffens | 141/290 X |
| 3,863,687 | 2/1975 | Alquist | 141/45 |

*Primary Examiner*—Robert B. Reeves
*Assistant Examiner*—Frederick R. Handren
*Attorney, Agent, or Firm*—Lane, Aitken, Dunner & Ziems

[57] ABSTRACT

A liquid dispensing and vapor recovery system in which an underground storage tank is connected to a first conduit for delivering a liquid, such as gasoline, to a vehicle gasoline tank or the like under the force of a pump located in the storage tank. A second conduit is connected to the first conduit and to the storage tank for diverting a portion of the gasoline in the first conduit back to the storage tank and an injector is located in the second conduit for forming a reduced pressure zone. A third conduit is connected to the vehicle tank and to the second conduit at the reduced pressure zone for drawing the vapors from the vehicle tank into the second conduit for passage into the storage tank. Valve means are provided which are responsive to the rate of flow of the liquid through the first conduit for regulating the flow of vapor through the third conduit.

10 Claims, 2 Drawing Figures

LIQUID DISPENSING AND VAPOR RECOVERY SYSTEM UTILIZING AN INJECTOR AND A VAPOR FLOW CONTROL VALVE

BACKGROUND OF THE INVENTION

This invention relates to a liquid dispensing and vapor recovery system and, more praticularly, to such a system in which liquid is dispensed from a storage tank to a receptacle while vapors from the receptacle are drawn tc the storage tank.

With the increased emphasis on preventing pollution of the atmosphere, recent attention has been directed to minimizing the introduction of gasoline vapors into the atmosphere from both permanent type underground storage tanks for the gasoline, and from the vehicles into which the gasoline is ultimately dispensed.

Gasoline vapors can easily be recovered from underground storage tanks by providing a separate vapor return line which connects the storage tank to the transport truck which periodically fills the tank. In this manner, the gasoline introduced into the tank from the transport truck will displace the vapors and force them through the vapor recovery line to the trunk whereby they are ultimately disposed of either by burning or through compression-refrigeration systems.

However, it has been extremely difficult to devise a satisfactory vapor recovery system from the gasoline tanks of vehicles. For example, previous proposals have utilized what is commonly referred to as a balanced displacement system in which the gasoline entering the tank forces the vapors through a separate line to the storage tank. However, this system has been less than satisfactory for several reasons, one of which is the difficulty in creating a proper seal between the gasoline dispensing and recovery nozzle and the automobile tank.

Although it has also been suggested to use a vacuum pump or a blower to remove the vapors from the vehicle tanks, this type of installation is disadvantageous from several standpoints. For example, the pump or blower is relatively expensive and creates potential safety problems due to the fact that it is electrically operated. Also, the output from the pump or blower is passed directly into the storage tank which pressurizes the tank and therefore increases vapor losses from the tank through its vent pipe.

In copending U.S. Pat. application Ser. No. 400,555, now U.S. Pat. No. 3,905,405, filed by Kirk Fowler and Elmer M. Deters on Sept. 25, 1973, and assigned to the same assignee of the present invention, a gasoline dispensing and vapor recovery system is disclosed which overcomes the above-mentioned problems by providing an injector for establishing a reduced pressure zone in response to fluid flow from the storage tank to the vehicle receptacle, with the reduced pressure zone functioning to draw the vapors from the receptacle back to the tank. Although this design has proven to be satisfactory, it has a limited operational range and is therefore not readily adaptable to dispensing installations of varying capacity.

SUMMARY OF THE INVENTION

It is, therefore, an object of the present invention to provide a liquid dispensing and vapor recovery system in which liquid is dispensed from a storage tank to a receptacle while vapors in the receptacle are recovered and delivered back to the storage tank.

It is a further object of the present invention to provide a liquid dispensing and vapor recovery system of the above type in which an injector is used to create a vacuum in response to the dispensing of the liquid from the storage tank to the receptacle, and is utilized to draw the vapors from the receptacle back to the tank.

It is a further object of the present invention to provide a liquid dispensing and vapor recovery system of the above type in which the vapor recovery is made in proportion to the liquid dispensed.

It is a further object of the present invention to provide a liquid dispensing and vapor recovery system of the above type which can be used in installations of varying capacity, yet utilizes an injector of a relatively small size.

It is a further object of the present invention to provide a liquid dispensing and vapor recovery system of the above type which is relatively simple in operation and relatively low in cost.

Toward the fulfillment of these and other objects, the system of the present invention comprises storage means for the liquid, first conduit means adapted to connect the storage means to a receptacle, pump means for pumping the liquid from the storage means through the first conduit means and to the receptacle, second conduit means connected to the first conduit means and to the storage means for diverting a portion of the liquid in the first conduit means back to the storage means, means for forming a reduced pressure zone in the second conduit means in response to liquid flow through the second conduit means, third conduit means connected to the second conduit means at the reduced pressure zone and to the receptacle for drawing the vapors from the receptacle into the second conduit means for passage into the storage means, and valve means responsive to the rate of flow of the liquid through the first conduit means for regulating the flow of vapor through the third conduit means.

DESCRIPTION OF THE PREFERRED EMBODIMENT

Figure 1:
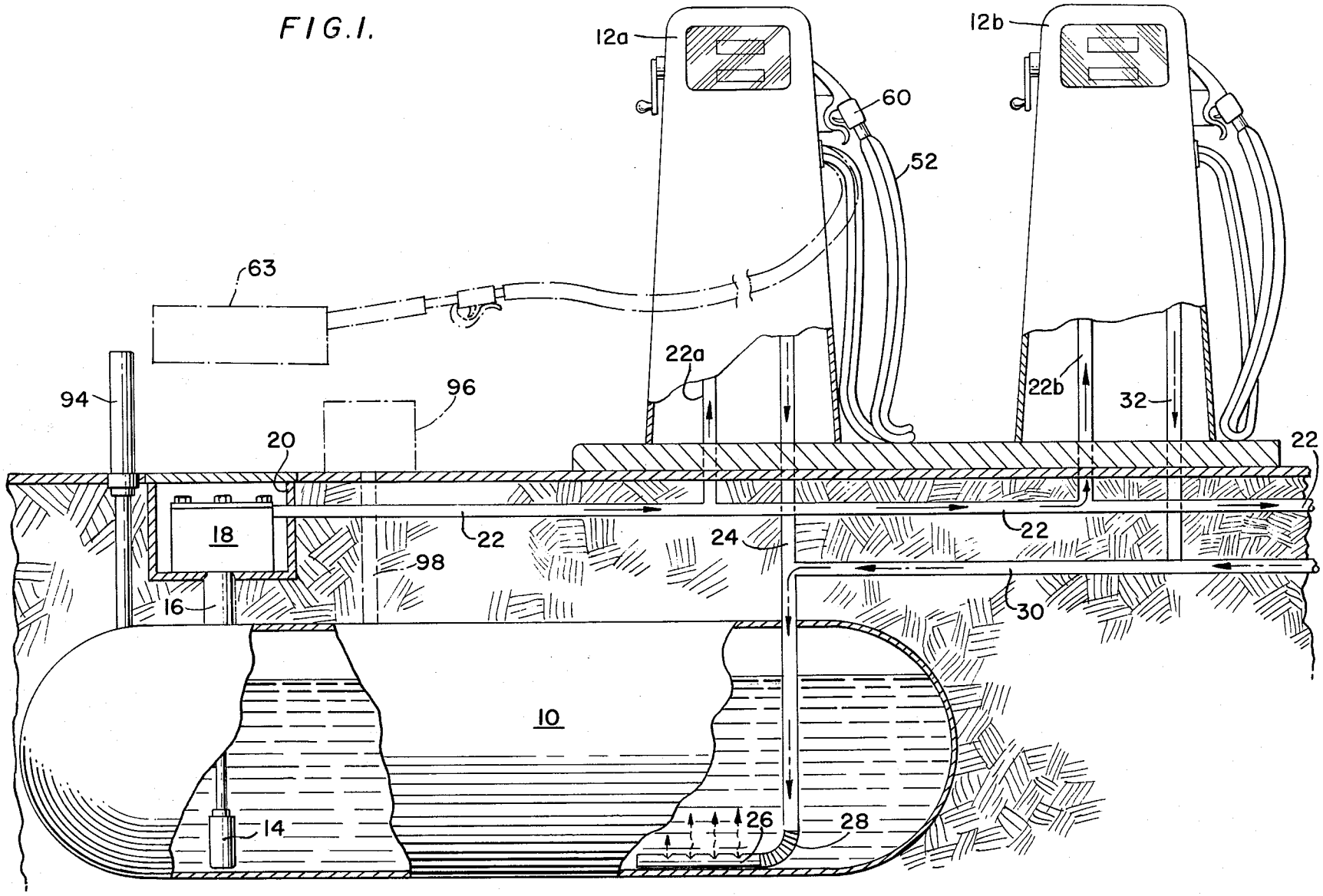
FIG. 1 is a partial schematic, partial elevational view of a service station installation having the dispensing and vapor recovery system of the present invention utilized therein.

As an example of the use of the liquid dispensing and vapor recovery system of the present invention, it will be described in connection with a gasoline dispensing installation for use in service stations or the like. Such an installation is illustrated in FIG. 1 and includes an undergound tank 10 for storing a quantity of gasoline which is delivered to two dispensing units, or pedestals, 12*a* and 12*b*. An electrically operated, centrifugal type submersible pump 14 is disposed in the tank and operates to draw the gasoline into the unit through a plurality of intake ports disposed at the bottom thereof, and to force the gasoline upwardly around a sealed electrical drive motor.

A casing 16 is attached to the tank 10 and extends upwardly therefrom to connect the outlet of the pump 14 to a discharge head, or manifold, 18 which is preferably disposed below ground level in a well 20. The manifold 18 is described in detail in U.S. Pat. No.

3,183,723, the disclosure of which is hereby incorporated by reference. Therefore, for the convenience of presentation, its structural details are not shown in the drawings, it being understood that it supports the upper portion of the pump unit 14 while permitting the electrical connections for the drive motor to be brought outwardly for connection to the proper controls. It is also understood that an adaptor unit, or packer, is supported within the housing of the manifold 18 and has an inlet chamber communicating with the outlet of the pump 14 and an outlet chamber adapted for registration with a substantially horizontal main conduit 22. The packer also defines a port between the inlet chamber and the outlet chamber which cooperates with a check valve to permit the flow of gasoline from the pump 14 to the conduit 22 while preventing flow in the opposite direction, also in a conventional manner.

A pair of substantially vertical branch conduits 22*a* and 22*b* connect the main conduit 22 to the pedestals 12*a* and 12*b*, respectively, for delivering the gasoline to the pedestals.

A substantially vertical vapor recovery conduit 24 extends from the pedestal 12*a* into the tank 10 and is connected to a discharge portion 26 by a flexible coupling 28. The discharge portion 26 can thus be doubled over to permit insertion through a relatively small opening in the tank 10 and, in use, lies in a substantially horizontal position on the floor of the tank as shown. The upper portion of the discharge portion 26 is perforated, as viewed in FIG. 1 to permit vapor from the conduit 24 to pass into the tank 10 and thus pass upwardly through the gasoline in the tank.

A horizontal vapor recovery conduit 30 is connected to the conduit 24 and to a substantially vertical conduit 32 extending from the pedestal 12*b*, so that vapor from the latter pedestal is introduced into the conduit 24 for passage into the tank 10. It is noted from the drawings that in installations having more than two pedestals, the conduits 22 and 30 can be extended to connect with other vertical conduits of the additional pedestals.

Figure 2:
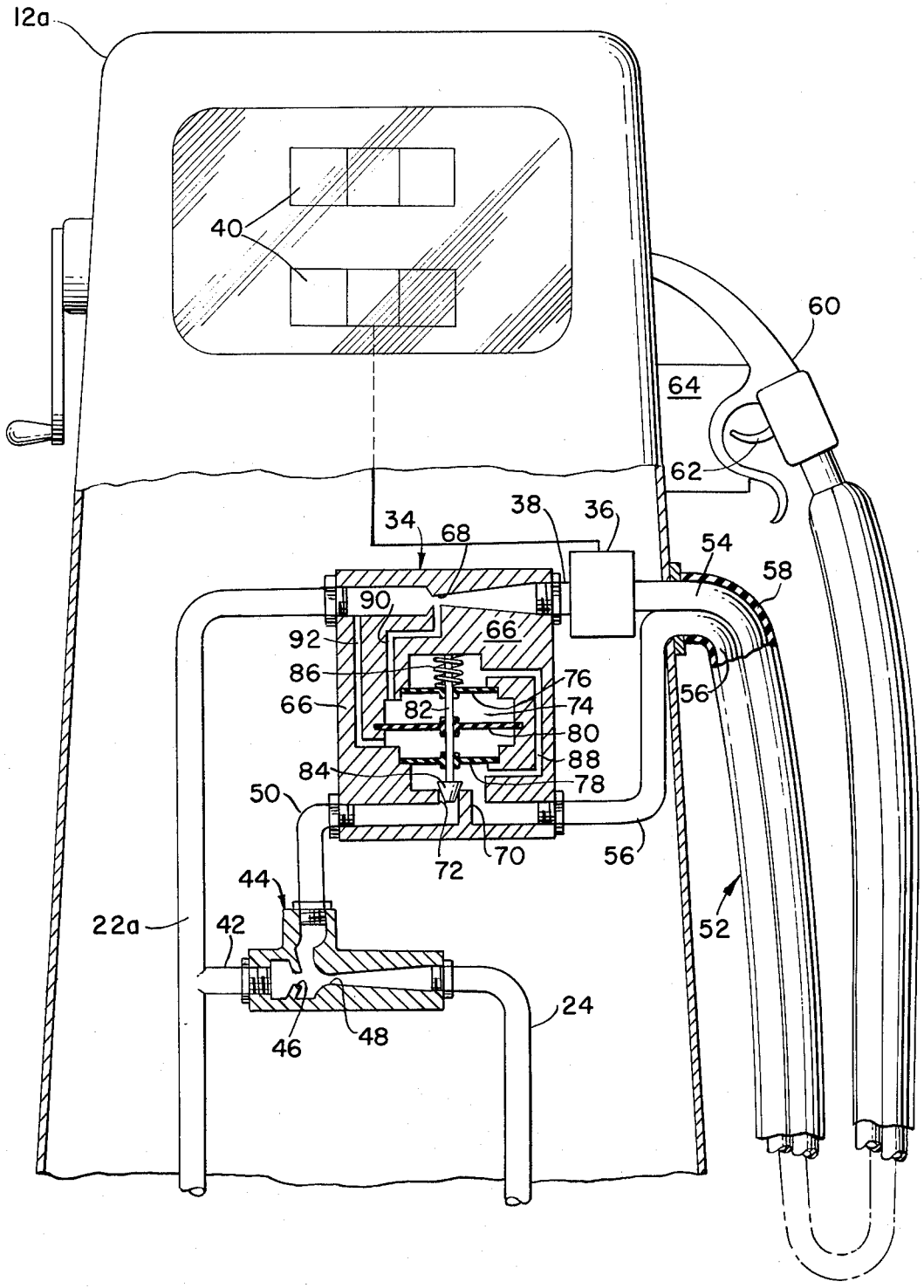
FIG. 2 is an enlarged, partial sectional, partial elevational view of a dispensing unit utilized in the installation of FIG. 1.

FIG. 2 depicts the details of pedestal 12*a*, it being understood that pedestal 12*b* is constructed in an identical manner. In particular, the gasoline conduit 22*a* is connected to a valve unit 34, which will be described in detail later, and a meter 36 is connected by a conduit 38 to an outlet of the valve unit for receiving the gasoline from the valve unit. The meter 36, which is not shown in detail since it is conventional, is mechanically connected to a pair of registers 40 for displaying the quantity and cost of the gasoline dispensed, also in a conventional manner.

A relatively short bypass pipe 42 is connected to the branch conduit 22*a* upstream of the valve unit 34 for diverting a portion of the gasoline flow through the latter conduit. An injector, shown in general by the reference numeral 44, has an inlet connected to the pipe 42 for receiving the diverted gasoline flow from the latter pipe. A nozzle 46 and a venturi 48 are formed in the injector 40 and cooperate to form a reduced pressure zone at the throat portion of the venturi upon a flow of the gasoline through the injector, in a conventional manner. The other end of the conduit 24 is connected to the outlet of the injector 44 for passing the gasoline back into the tank. A conduit 50 connects the injector 44 to the valve unit 34 for reasons to be described in detail later.

A hose assembly 52 extends from the pedestal 12*a* and includes a pair of juxtapositioned hoses 54 and 56 surrounded by a protective cover 58. The hoses 54 and 56 extend into the pedestal housing with the hose 54 being connected to an outlet of the meter 36, and the hose 56 being connected to a vapor inlet formed in the valve unit 34.

A dispensing unit 60 is connected to the free end of the hose assembly 52, it being understood that the unit 60 includes a gasoline dispensing nozzle connected to the hose 54 and a vapor recovery conduit connected to the hose 56. The dispensing unit 60 is operated by a manually operated valve 62, in a conventional manner, to dispense the gasoline to a vehicle gasoline tank 63, or other type receptacle.

A support and switch assembly 64 is connected to the pedestal 12*a* and is adapted to support the dispensing unit. It is understood that the assembly 64 includes a switch which operates to actuate the pump unit 14, in a conventional manner.

Since the valve unit 34 is manufactured as model SFIFEO1 by ITT General Controls of Glendale, California, and, per se, does not form any portion of the present invention, it will be described only generally as follows. The valve includes a housing 66 having a venturi passage 68 defined therein which has an inlet portion connected to the conduit 22*a* for receiving the gasoline, and an outlet for supplying the gasoline to the meter 36 via the line 38. The valve unit 34 also defines an inlet port 70 which registers with the hose 56 for receiving the vapors from the dispensing unit 60, and an outlet port 72 which registers with the conduit 50 extending from the injector 44.

The interior of the housing 66 is hollow and defines a chamber 74 which is bounded by a pair of membranes 76 and 78 mounted to corresponding surfaces defined within the housing. The chamber 74 is divided into an upper and lower portion by a central membrane 80 extending across the chamber 74 and supported along its edge portion by within a slot formed in the housing. A valve stem 82 is disposed in the chamber 74, extends through openings in the membranes 76, 78, and 80 and is secured to the membranes. A valve head 84 is disposed at the end of the stem 82 and cooperates with the outlet port 72 to regulate the flow of vapor through this port. A spring 86 extends between a surface defined in the housing 66 and the membrane 76 to normally urge the latter membrane, and therefore the valve stem 82 and the valve head 84 into a closed position relative to the outlet port 72.

A passage 88 connects the chamber defined above the membrane 76 to the chamber defined below the membrane 78 for equalizing the vapor pressures in these chambers. A passage 90 connects the reduced pressure zone of the venturi 68 to the upper portion of the chamber 74, and a passage 92 connects the lower portion of the chamber 74 to the venturi 68 upstream of the reduced pressure zone, for the purposes of creating a pressure differential across the membrane 80 in response to the flow of gasoline through the venturi 68. As a result of this latter flow, the membrane 80 and therefore the valve stem 82 and valve head 84 are urged upwardly against the force of the spring 86.

In operation, upon an operator releasing the dispensing unit 60 from its support and switch assembly 64 on the pedestal 12*a*, for example, and actuating the associated switch, the pump 14 will be actuated to pump gasoline from the tank 10 through the manifold 18 and conduits 22 and 22*a*. The main portion of gasoline flow through the conduit 22*a* will pass into the valve unit 34, where it will pass through the venturi 68 and then exit before passing through the meter 36 and the hose 54 to the dispensing unit 60 to deliver gas to the latter unit for introduction into the vehicle gasoline tank 63.

A portion of the gasoline flowing through the conduit 22*a* upstream of the valve unit 34 will be diverted into the pipe 42 and will pass into the injector 44, where it passes through the nozzle 46 and the venturi 48 before passing into the vapor recovery conduit 24 and back to the tank 10. As a result, a reduced pressure zone will be formed in the injector 44 which is transferred, through the conduit 50 and the valve unit 34, to the hose 56. This reduced pressure zone, plus the force of the gasoline as it displaces the vapors from the vehicle tank 63, will cause the vapors to pass from the vehicle tank into and through the hose 56 where it passes into the inlet port 70 of the valve unit 34.

If the differential pressure across the membrane 80 by virtue of the positive pressure applied to the lower portion of the chamber 74 via the conduit 92, and the negative pressure applied to the upper portion of the chamber 74 via the conduit 90, is of sufficient magnitude, the membrane 80 and therefore the valve head 84 will be urged upwardly against the force of the spring 76 to expose a portion of the outlet port 72. This permits the vapors to flow from the inlet port 70, through the outlet port 72 and the conduit 50 to the injector 44 with the amount of vapor flow being modulated by the valve head 84 in response to the flow of gasoline through the valve unit 34.

In the injector 44, the vapors pass through the venturi portion 48 where they are partially absorbed by the gasoline from the pipe 42 passing through the injector. The resulting mixture then passes from the injector 44, through the conduit 24, and into the lower portion of the tank where they will exit through the perforations formed in the discharge portion 26, and rise upwardly through the gasoline in the tank. The vapors are thus at least partially absorbed by the gasoline passing through the injector 44 and by the gasoline in the tank 10. Those vapors not absorbed in the above process will either condense in the tank 10 or will be recovered by the gasoline transport truck in the manner discussed above.

It is thus seen that, by virtue of the combination of the injector 44 and valve unit 34, that a precise control of the vapor recovery can be achieved, thus permitting the units to be used in installations of varying capacity yet insuring an optimum negative pressure in the vapor recovery line to insure full recovery of the vapors while eliminating the possibility of pressurizing the tank 10 or damaging the vehicle tank by virtue of a too high negative pressure occurring.

It is noted that the storage tank 10 is provided with a vent pipe 94 for exhausting vapor from the tank which may form due to diurnal losses and that an optional condenser system 96 may be provided which is connected to the tank 10 via a line 98, and which is adapted to condense any excessive vapors in the tank 10. Since this type of condenser system is well known in the art, it will not be described in any further detail.

It is thus seen that the present invention provides an effective and safe means of recovering vapors in a vehicle tank while minimizing the pollution of the atmosphere. It is noted that the system of the present invention is not limited to the dispensing of gasoline and the recovery of gasoline vapors but could be applied to any installation, such as chemical plants or the like, in which vapor recovery is desired.

Of course, other variations of the specific construction and arrangement of the system disclosed above can be made by those skilled in the art without departing from the invention as defined in the appended claims.

We claim:

1. A liquid dispensing and vapor recovery system comprising storage means for said liquid, first conduit means adapted to connect said storage means to a receptacle, pump means for pumping said liquid from said storage means through said first conduit means and to said receptacle, second conduit means connected to said first conduit means and to said storage means for diverting a portion of said liquid in said first conduit means back to said storage means, means for forming a reduced pressure zone in said second conduit means in response to liquid flow through said second conduit means, third conduit means connected to said second conduit means at said reduced pressure zone and to said receptacle for drawing the vapors from said receptacle into said second conduit means for passage into said storage means, and valve means disposed in said third conduit means for continuously changing the flow rate of vapor through said third conduit means in proportion to changes in the flow rate of liquid through said first conduit means.

2. The system of claim 1 wherein said means for forming a reduced pressure zone comprises a nozzle and a venturi disposed in said second conduit means.

3. The system of claim 1 wherein said vapors mix with said liquid in said second conduit means.

4. The system of claim 1 further comprising a dispensing device connected to said first conduit means and to said third conduit means for dispensing said liquid from said first conduit means into said receptacle and for receiving vapors from said receptacle.

5. The system of claim 1 wherein said liquid is fuel, said storage means is an underground storage tank, and said receptacle is a vehicle fuel tank.

6. A liquid dispensing and vapor recovery system comprising storage means for said liquid, first conduit means adapted to connect said storage means to a receptacle, pump means for pumping said liquid from said storage means through said first conduit means and to said receptacle, second conduit means in open communication with said first conduit means and connected to said storage means for continuously diverting a portion of said liquid in said first conduit means back to said storage means, means for forming a reduced pressure zone in said second conduit means in response to liquid flow through said second conduit means, third conduit means connected to said second conduit means at said reduced pressure zone and to said receptacle for drawing the vapors from said receptacle into said second conduit means for passage into said storage means, and valve means disposed in said third conduit means and responsive to the rate of flow of said liquid through said first conduit means for modulating the flow of vapor through said third conduit means.

7. The system of claim 6 wherein said means for forming a reduced pressure zone comprises a nozzle and a venturi disposed in said second conduit means.

8. The system of claim 6 wherein said vapors mix with said liquid in said second conduit means.

9. The system of claim 6 further comprising a dispensing device connected to said first conduit means and to said third conduit means for dispensing said liquid from said first conduit means into said receptacle and for receiving vapors from said receptacle.

10. The system of claim 6 wherein said liquid is fuel, said storage means is an underground storage tank, and said receptacle is a vehicle fuel tank.

* * * * *